US009318829B2

(12) United States Patent
Yu et al.

(10) Patent No.: US 9,318,829 B2
(45) Date of Patent: Apr. 19, 2016

(54) POWER CONNECTOR AND POWER CONTACT THEREOF WITH IMPROVED SUPPORT MEMBER FOR SUPPORTING ENGAGING ARM

(71) Applicant: ALLTOP ELECTRONICS (SUZHOU) LTD., Taicang, JiangSu Province (CN)

(72) Inventors: Wang-I Yu, Jhonghe (TW); Hung-Chi Tai, Jhonghe (TW); Yung-Chih Hung, Jhonghe (TW)

(73) Assignee: ALLTOP ELECTRONICS (SUZHOU) LTD., Taichung (JP)

( * ) Notice: Subject to any disclaimer, the term of this patent is extended or adjusted under 35 U.S.C. 154(b) by 157 days.

(21) Appl. No.: 14/073,204

(22) Filed: Nov. 6, 2013

(65) Prior Publication Data

US 2015/0031249 A1 Jan. 29, 2015

(30) Foreign Application Priority Data

Jul. 25, 2013 (CN) ..... 2013 1 0315792

(51) Int. Cl.
*H01R 12/00* (2006.01)
*H01R 13/18* (2006.01)
*H01R 13/11* (2006.01)

(52) U.S. Cl.
CPC ..... *H01R 13/18* (2013.01); *H01R 13/113* (2013.01)

(58) Field of Classification Search
CPC ..... H01R 13/18; H01R 13/113; H01R 13/112
USPC ..... 439/83, 682, 852, 857
See application file for complete search history.

(56) References Cited

U.S. PATENT DOCUMENTS

| | | | | |
|---|---|---|---|---|
| D409,142 | S * | 5/1999 | Yoshiura | D13/133 |
| 5,941,741 | A * | 8/1999 | Dobbelaere | H01R 13/113 439/852 |
| 7,575,487 | B2 * | 8/2009 | Yodogawa | H01R 13/113 439/830 |
| 8,317,529 | B2 * | 11/2012 | Katano | H01R 13/115 439/251 |
| 2004/0142605 | A1 * | 7/2004 | Harada | H01R 4/185 439/857 |

* cited by examiner

*Primary Examiner* — Khiem Nguyen
(74) *Attorney, Agent, or Firm* — Sughrue Mion, PLLC

(57) ABSTRACT

A power contact includes a fixing portion, an engaging arm extending backwardly from a front end of the fixing portion along a first direction and a support member extending towards the engaging arm. The support member is positioned between the engaging arm and the fixing portion along a second direction perpendicular to the first direction. The support member is adapted for abutting against the engaging arm so as to increase insertion/withdraw force and avoid over deformation of the engaging arm.

12 Claims, 8 Drawing Sheets

POWER CONNECTOR AND POWER CONTACT THEREOF WITH IMPROVED SUPPORT MEMBER FOR SUPPORTING ENGAGING ARM

BACKGROUND OF THE INVENTION

1. Field of the Invention

The present invention relates to a power connector and a power contact thereof, and more particularly to a power connector and a power contact thereof with an improved support member for supporting an engaging arm.

2. Description of Related Art

With rapid development of electronic technologies, power connectors have been widely used in electronic devices for power supply. A conventional power connector usually includes an insulative housing and a plurality of power contacts received in the insulative housing. Each power contact includes a soldering portion extending beyond the insulative housing for being mounted to a circuit board. A connector assembly including a plug power connector and a receptacle power connector for mating with the plug power connector is usually applied in the electronic devices.

In order to meet the requirements of stable signal transmission and high effective transmission of the electronic devices, strong mating stabilization of the power connectors need to be ensured. However, contacting arms of conventional receptacle power connectors are short and are provided with limited deformation scope. Under this condition, when plug contacts of large thickness are inserted thereinto, the contacting arms of the conventional receptacle power connectors may occur permanent deformation which will damage the receptacle power connector.

Hence, it is desirable to provide an improved power connector and a power contact thereof to solve the above problems.

BRIEF SUMMARY OF THE INVENTION

The present invention provides a power connector including an insulative housing and a plurality of power contacts fixed to the insulative housing. Each power contact includes a base portion in a shape of sheet and defines an up-to-down direction and an up end thereof, a pair of fixing portions bended perpendicularly from a pair of linear side of the base portion near the up end thereof and extending in a front-to-rear direction perpendicular to the up-to-down direction, a pair of engaging arms extending backwardly from a front ends of the fixing portions, respectively, and a pair of support members respectively stamped from the fixing portions and extending forwardly and inwardly towards the engaging arms. The pair of engaging arms is located between the fixing portions. Each of the engaging arms has a front arm extending rearwardly from the front end of the fixing portion and away from the fixing portion, a rear arm connecting with the front arm and being bent toward the fixing portion and a contact portion formed at a boundary of the front arm and the rear arm. Each the support member is a cantilevered arm having an engaging portion at a distal end thereof. The engaging portion is disposed between the rear arm and the fixing portion in such a manner that the engaging portion is correspondingly aligned with the rear arm of the engaging arm in an inward-to-outward direction perpendicular to the fixing portion. when a complementary plug mated with the power connector, the contact portion of the engaging arm is pressed by the complementary plug and the engaging portion of the support member is adapted to abut against the rear arm of the engaging arm.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

The components in the drawing are not necessarily drawn to scale, the emphasis instead being placed upon clearly illustrating the principles of the described embodiments. In the drawings, reference numerals designate corresponding parts throughout various views, and all the views are schematic.

DETAILED DESCRIPTION OF THE PREFERRED EMBODIMENTS

Figure 1:
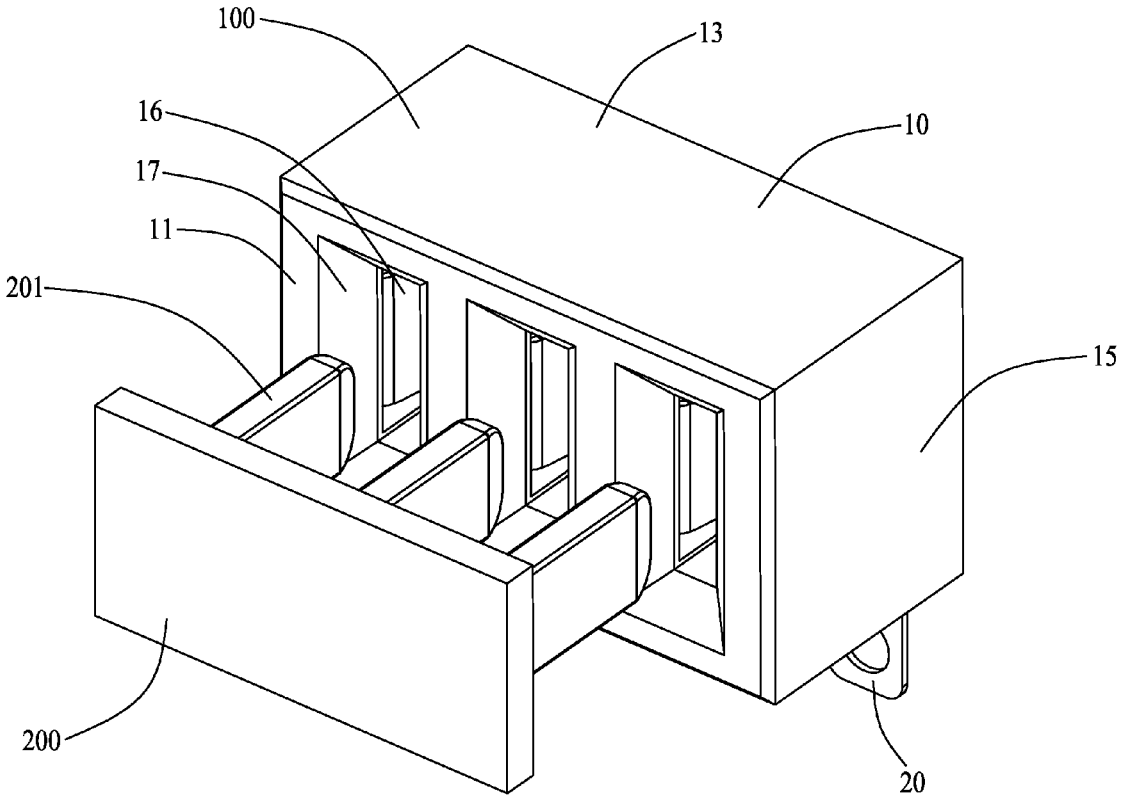
FIG. 1 is a perspective view of a power connector and a complementary plug in accordance with an illustrated embodiment of the present invention.
Figure 2:
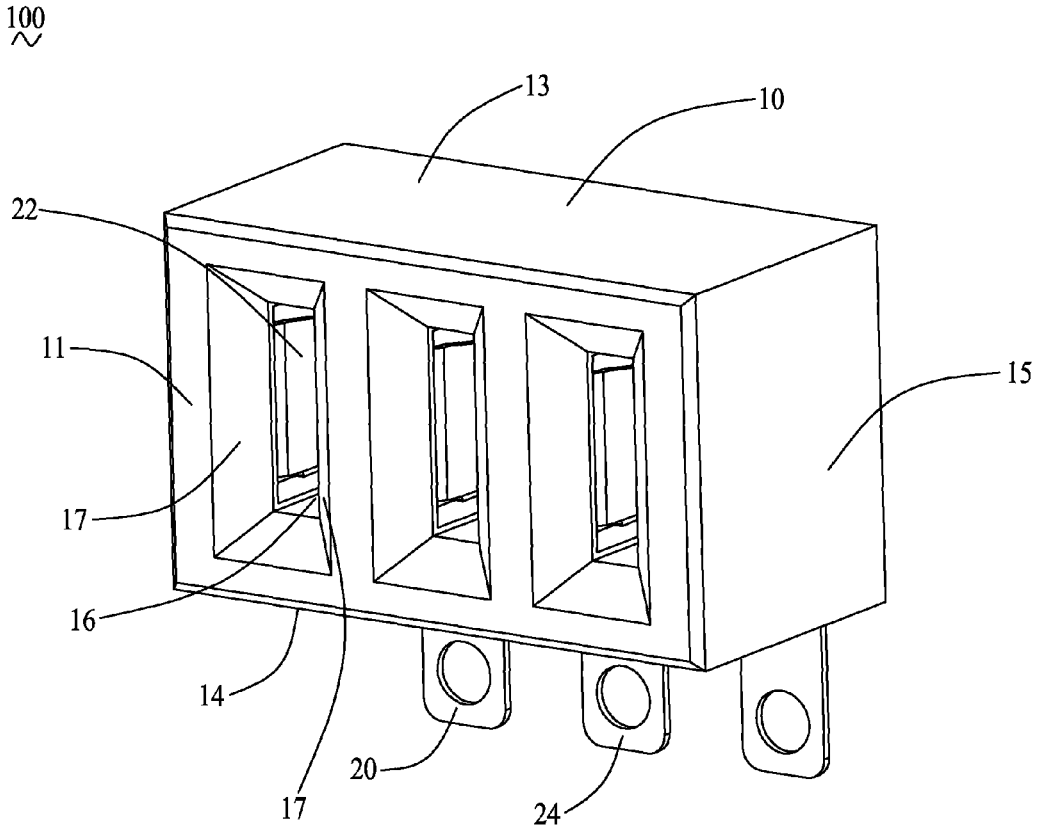
FIG. 2 is a perspective view of the power connector as shown in FIG. 1.

Reference will now be made to the drawing figures to describe the embodiments of the present invention in detail. In the following description, the same drawing reference numerals are used for the same elements in different drawings.

Referring to FIG. 1, the present invention discloses a power connector 100 for being mounted to a circuit board (not shown) to receive a complementary plug 200. The power connector 100 includes an insulative housing 10 and a plurality of power contacts 20 retained in the insulative housing 10 for mating with contacts 201 of the complementary plug 200.

Referring to FIGS. 2 to 5, the insulative housing 10 includes a front surface 11, a rear surface 12 opposite to the front surface 11 and four peripheral walls between the front surface 11 and the rear surface 12. The four peripheral walls includes a top wall 13, a bottom wall 14 opposite to the top wall 13, and a pair of side walls 15 connecting the top wall 13 and the bottom wall 14.

Figure 4:
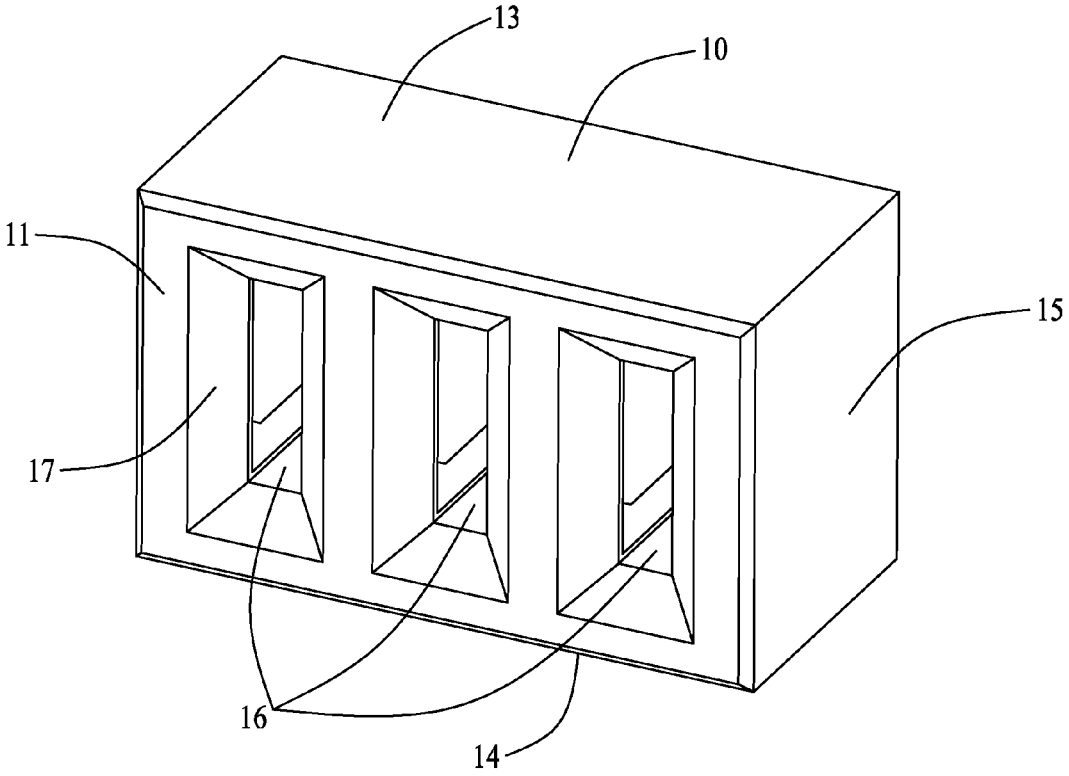
FIG. 4 is a perspective view of an insulative housing of the power connector as shown in FIG. 3.
Figure 5:
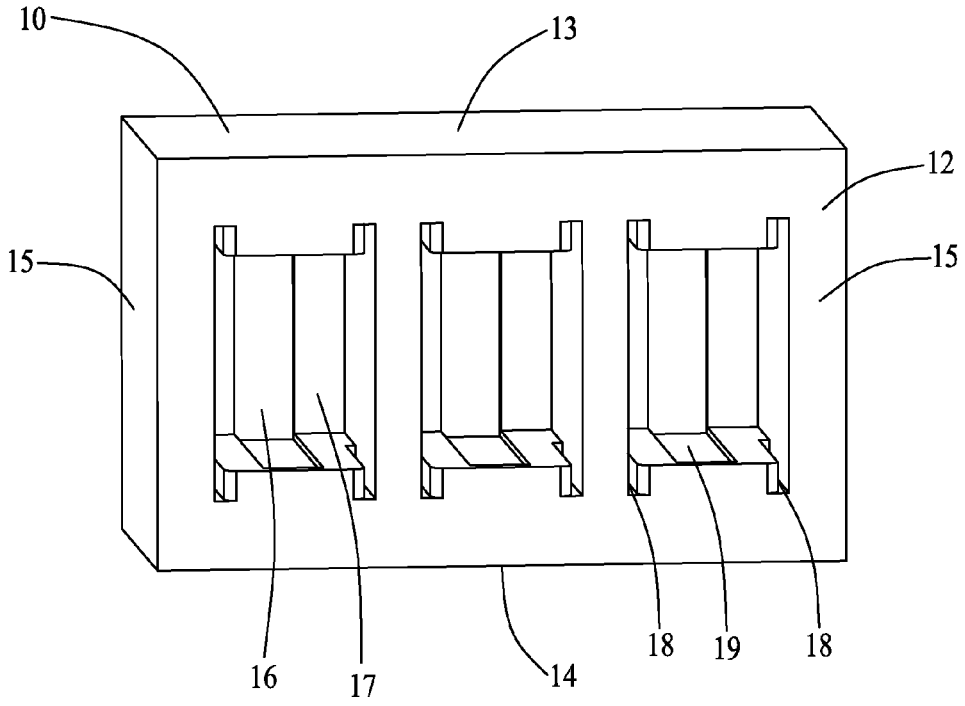
FIG. 5 is another perspective view of the insulative housing as shown in FIG. 4.

Referring to FIGS. 4 and 5, the insulative housing 10 includes a plurality of rectangular chambers 16 extending through the front surface 11 and the rear surface 12 for accommodating the power contacts 20. The insulative housing 10 includes a plurality of slots 18 extending through the rear surface 12. The slots 18 are divided into three pairs each of which are in communication with corresponding chamber 16. Besides, each pair of slots 18 are located at lateral sides of the corresponding chamber 16. In addition, a plurality of restricting slots 19 are formed on a top side of the bottom wall 14. Each restricting slot 19 is in communication with the corresponding chamber 16 for positioning the complementary plug 200 when it is inserted into the chambers 16. The insulative housing 10 includes a pair of inclined stop walls 17 located adjacent to the front surface 11. The stop walls 17 protruding into the chambers 16 for positioning the power contacts 20 when the power contacts 20 are assembled into the insulative housing 10 from the rear surface 12. Besides, the inclined stop walls 17 are adapted for guiding insertion of the complementary plug 200. A distance between the pair of stop walls 17 in each chamber 16 is equal to a width of the restricting slot 19 as a result that the complementary plug 200 can be well regulated when it is inserted into the power connector 100.

Figure 3:
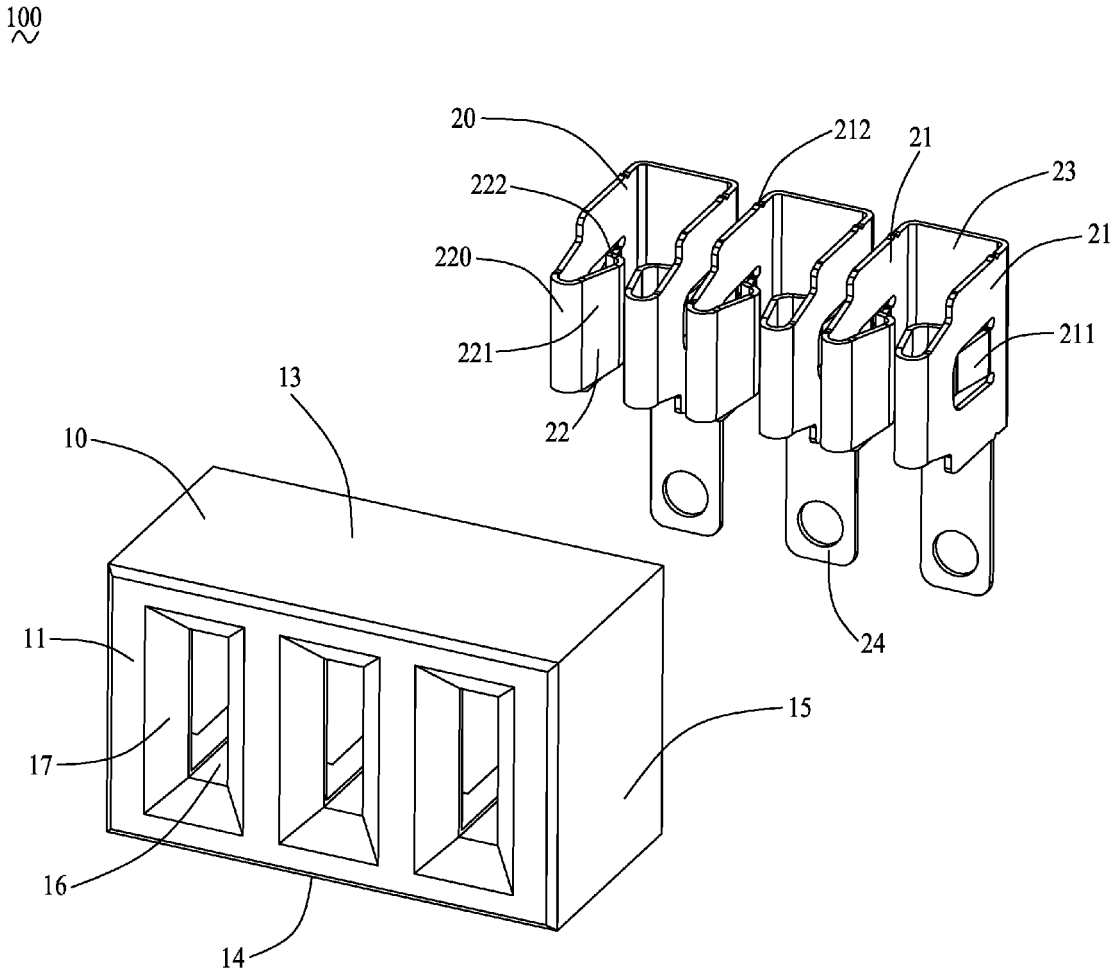
FIG. 3 is an exploded view of the power connector as shown in FIG. 2.
Figure 6:
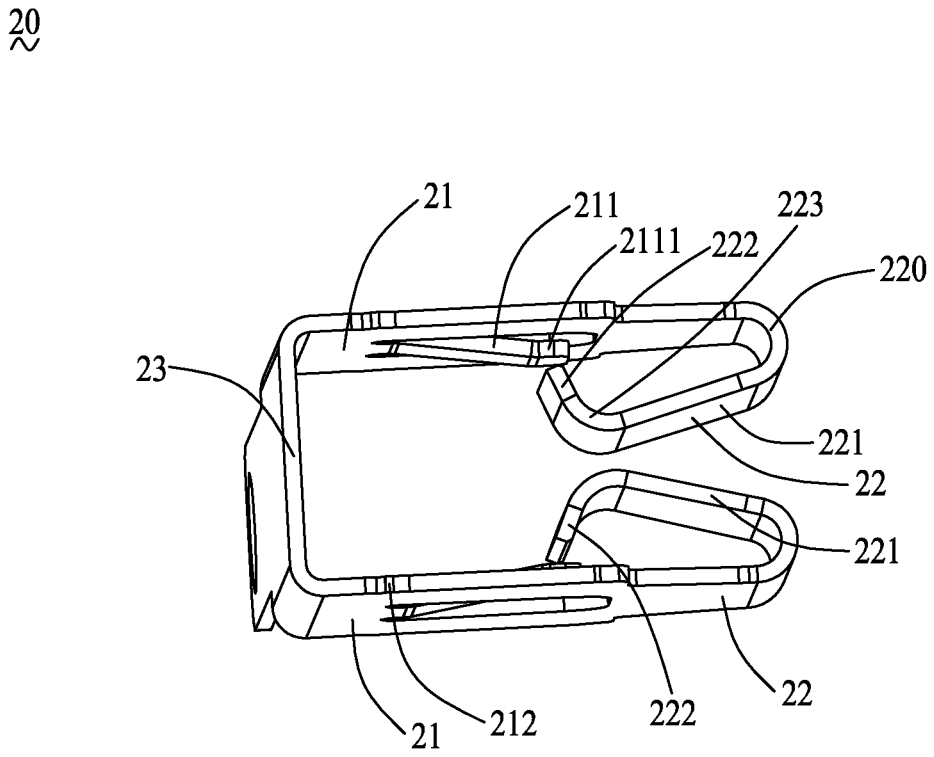
FIG. 6 is a perspective view of a power contact according to a first illustrated embodiment.
Figure 7:
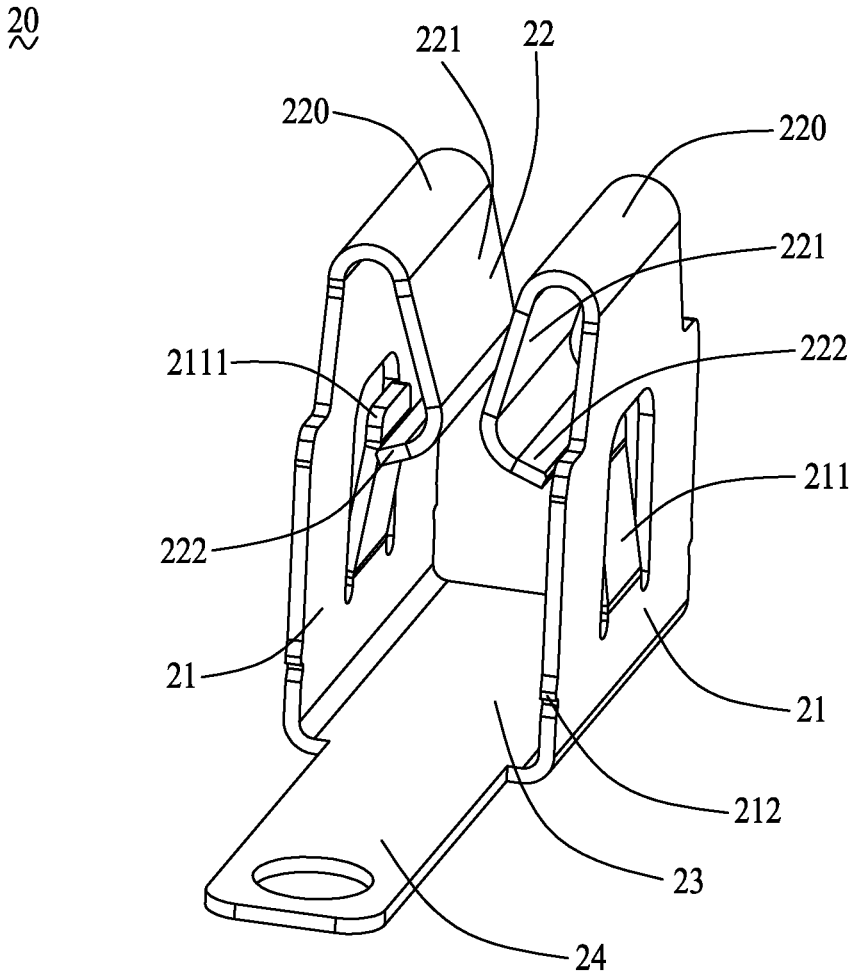
FIG. 7 is another perspective view of the power contact taken from a different aspect.

Referring to FIGS. 3, 6 and 7, according to a first illustrated embodiment of the present invention, each power contact 20 is essential of a symmetrical configuration and includes a base portion 23 in a shape of sheet and defines an up-to-down direction and an up end (not labeled) thereof, a pair of fixing portions 21 bended perpendicularly from a pair of linear side of the base portion 23 near the up end thereof and extending in a front-to-rear direction perpendicular to the up-to-down direction, a pair of engaging arms 22 extending backwardly from a front ends 220 of the fixing portions 21, respectively, and a soldering portion 24 extending downwardly from the base portion 24 for being soldered to a circuit board.

Each of the fixing portions 21 includes a support member 211 stamped from the fixing portions 21 and extending forwardly and inwardly towards the engaging arms 22. The pair of engaging arms is located between the pair of fixing portions 21. The fixing portion 21 is wider than the engaging arm 22 measured in the up-to-down direction. The support member 211 is adapted for abutting against the engaging arm 22 so as to increase insertion/withdraw force and avoid over deformation of the engaging arm 22.

According to the illustrated embodiments of the present invention, the support arm 211 and the corresponding engaging arm 22 from the same base portion 23 extend essentially along two different directions, as shown in FIG. 7. The two different directions intersect with each other in an obtuse angle. The support arm 211 is narrower than the engaging arm 22 measured in the up-to-down direction for easy manufacture. The support member 211 is a cantilevered arm which includes an engaging portion 2111 at a distal end thereof for abutting against the engaging arm 22.

The engaging arm 22 includes a front arm 221 slantwise extending rearwardly from the front end 220 the fixing portion 21 and away from the fixing portion 21, a rear arm 222 connecting with the front arm 221 and bent towards the fixing portion 21 and a contact portion 223 formed at a boundary of the front arm 221 and the rear arm 222 for mating with the contact 201 of the complementary plug 200. As shown in FIG. 6, the engaging portion 2111 of the support member 211 is positioned between the rear arm 222 and the corresponding fixing portion 21 in such a manner that the engaging portion 2111 is correspondingly aligned with the rear arm 222 of the engaging arm 22 in an inward-to-outward direction perpendicular to the fixing portion 21. The engaging portion 2111 is adapted for abutting against the rear arm 222 so as to increase insertion/withdraw force and avoid over deformation of the engaging arm 22.

The fixing portion 21 includes a plurality barbs 212 rigidly abutting against an inner side of the slot 18 for secure fixation. The front end 220 of the fixing portion 21 from which the engaging arm 22 is restricted by and located behind the stop wall 17. The engaging arm 22 protrudes into the chamber 16 for mating with the complementary plug 200.

Figure 8:
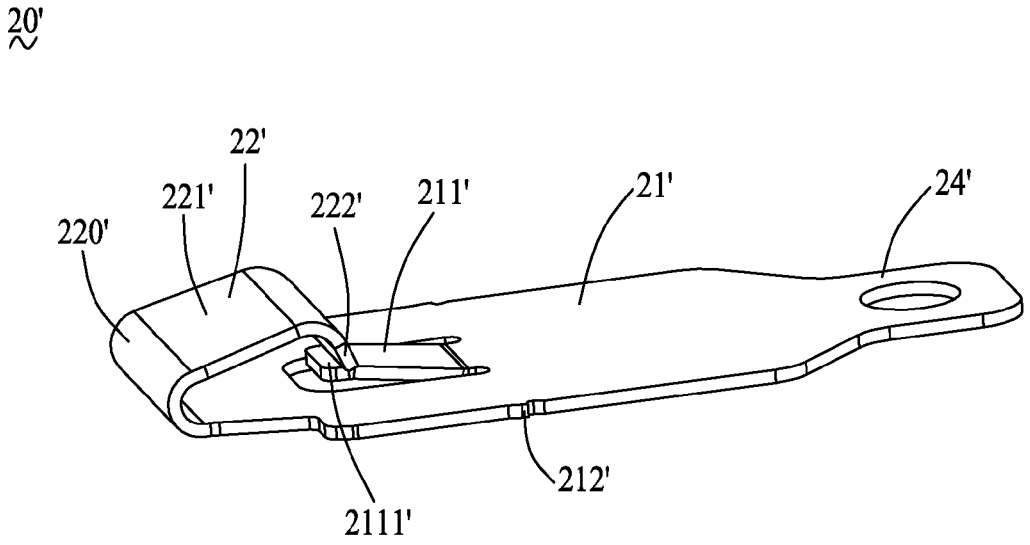
FIG. 8 is a perspective view of a power contact according to a second illustrated embodiment.

Referring to FIGS. 3 and 8, according to a second illustrated embodiment of the present invention, each power contact 20' is substantially a half of the power contact 20 illustrated in the first embodiment. The same numerals in the first and the second illustrated embodiments represent the same configurations. For example, the fixing portion 21', the engaging arm 22', the support member 211' and related features of the power contact 20' are the same as those of the power contact 20. The main differences between them are that the power contact 20' is not provided with a connecting beam 23 shown in FIG. 7, and each power contact 20' includes a soldering portion 24' extending from the fixing portion 21' along the first direction. The soldering portion 24' and the fixing portion 21' are coplanar with each other.

It is understandable that a single power contact 20 illustrated in the first embodiment is corresponding to receive a single contact 201 of the complementary plug 200, while a pair of the power contacts 20' are required for cooperatively receiving a single contact 201 of the complementary plug 200.

When the complementary plug 200 is inserted into the power connector 100, if each contact 201 of the complementary plug 200 is of small thickness, a little deformation of each engaging arm 22 occurs. Under this condition, the engaging portion 2111 will not abut against the rear arm 222 so as to realize small insertion/withdraw force. However, if the contact 201 of the complementary plug 200 is of large thickness, great deformation of each engaging arm 22 occurs. Under this condition, the engaging portion 2111 will abut against the rear arm 222 to increase insertion/withdraw force and avoid over deformation of the engaging arm 22. The configurations of the power contacts 20, 20' of the illustrated embodiments of the present invention are of excellent compatibility and are suitable for wide applications.

It is to be understood, however, that even though numerous characteristics and advantages of preferred and exemplary embodiments have been set out in the foregoing description, together with details of the structures and functions of the embodiments, the disclosure is illustrative only; and that changes may be made in detail within the principles of present disclosure to the full extent indicated by the broadest general meaning of the terms in which the appended claims are expressed.

What is claimed is:

1. A power contact comprising:

a fixing portion extending in a front-to-back direction, each of the fixing portion defining a front end;

an engaging arm extending backwardly and slantwise from the front end of the fixing portion, the engaging arm having a front arm extending backwardly from the front end of the fixing portion and being obliquely away from the fixing portion, a rear arm connecting with the front arm and being bent toward the fixing portion and a contact portion formed at a boundary of the front arm and the rear arm; and a support member stamped from the fixing portion and extending forwardly and inwardly towards the engaging arm, wherein the support member is a cantilevered arm having an engaging portion at a distal end thereof, the engaging portion being disposed between the rear arm and the fixing portion in such a manner that the engaging portion is correspondingly aligned with the rear arm of the engaging arm in an inward-to-outward direction perpendicular to the fixing portion, and wherein the engaging portion is adapted for abutting against the rear arm.

2. The power contact as claimed in claim 1, wherein the power contact is of a symmetrical configuration with a base portion in a shape of sheet and defines an up-to-down direction, the fixing portion being a pair of the fixing portions bent perpendicularly from a pair of linear side of the base portion near an up end thereof, the engaging arm being a pair of the engaging arms extending backwardly from a front ends of the fixing portions, respectively, the support member being a pair of the support members stamped from the pair of fixing portions, respectively.

3. The power contact as claimed in claim 2, further comprising a soldering portion extending downwardly from the base portion.

4. A power contact essentially of a symmetrical configuration and comprising:

a base portion, which is in a shape of sheet and defines an up-to-down direction and an up end thereof;

a pair of fixing portions arranged in parallel relationship with each other, which are bend perpendicularly from a pair of linear side of the base portion near the up end thereof and extend in a front-to-rear direction perpendicular to the up-to-down direction, each of the fixing portion defining a front end;

a pair of engaging arms extending backwardly from the front ends of the fixing portions, respectively, the pair of engaging arms being located between the fixing portions, each of the engaging arms having a front arm extending rearwardly from the front end of the fixing portion and away from the fixing portion, a rear arm connecting with the front arm and being bent toward the fixing portion and a contact portion formed at a boundary of the front arm and the rear arm; and a pair of support members respectively stamped from the fixing portions and extending forwardly and inwardly towards the engaging arms, wherein each the support members is a cantilevered arm having an engaging portion at a distal end thereof, the engaging portion being disposed between the rear arm and the fixing portion in such a manner that the engaging portion is correspondingly aligned with the rear arm of the engaging arm in an inward-to-outward direction perpendicular to the fixing portion, and wherein the engaging portion is adapted for abutting against the rear arm.

5. The power contact as claimed in claim 4, wherein the support member and the corresponding engaging arm from the same base portion extending essentially along two different directions, the two different directions intersecting with each other in an obtuse angle.

6. The power contact as claimed in claim 5, wherein each fixing portion is wider than the engaging arm measured along the up-to-down direction, and wherein the engaging arm is also wider than the resilient arm along the up-to-down direction.

7. A power connector mated with a complementary plug, comprising:

an insulative housing comprising a front surface, a rear surface, a slot extending through the rear surface and a chamber extending through the front surface and the rear surface; and a power contact comprising a fixing portion fixed in the slot, an engaging arm extending backwardly from a front end of the fixing portion and a support member stamped from the fixing portion, the engaging arm extending into the chamber mating with the complementary plug, the engaging arm having a front arm extending backwardly from the front end of the fixing portion and being obliquely away from the fixing portion, a rear arm connecting with the front arm and being bent toward the fixing portion and a contact portion formed at a boundary of the front arm and the rear arm, the contact portion contact with the complementary plug, the support member extending forwardly and inwardly towards the engaging arm, wherein the support member is a cantilevered arm having an engaging portion at a distal end thereof, the engaging portion being disposed between the rear arm and the fixing portion in such a manner that the engaging portion is correspondingly aligned with the rear arm of the engaging arm in an inward-to-outward direction perpendicular to the fixing portion; and wherein when the complementary plug inserted into the chamber, the contact portion of the engaging arm is pressed by the complementary plug and the engaging portion of the support member is adapted to abut against the rear arm of the engaging arm.

8. The power connector as claimed in claim 7, wherein the resilient arm and the engaging arm extending essentially along two different directions, the two different directions intersecting with each other in an obtuse angle.

9. The power connector as claimed in claim 7, further comprising a soldering portion extending from the fixing portion along the first direction.

10. The power connector as claimed in claim 7, wherein the power contact is of a symmetrical configuration with a base portion in a shape of sheet and defines an up-to-down direction, the fixing portion being a pair of the fixing portions bend perpendicularly from a pair of linear side of the base portion near an up end thereof, the engaging arm being a pair of the engaging arms extending backwardly from a front ends of the fixing portions, respectively, the support member being a pair of the support members stamped from the pair of fixing portions, respectively.

11. The power contact as claimed in claim 10, further comprising a soldering portion extending downwardly from the base portion.

12. The power contact as claimed in claim 10, wherein the fixing portion is wider than the engaging arm measured along the up-to-down direction and wherein the engaging arm is also wider than the resilient arm along the up-to-down direction.

* * * * *